United States Patent [19]

Rutledge

[11] Patent Number: 4,813,651

[45] Date of Patent: Mar. 21, 1989

[54] FENCE POST WITH SADDLE SUPPORT CONSTRUCTION AND METHOD THEREFORE

[76] Inventor: Terry G. Rutledge, 9792 E. Ocotillo Rd., Scottsdale, Ariz. 85260

[21] Appl. No.: 213,996

[22] Filed: Jun. 30, 1988

[51] Int. Cl.[4] ..... E04H 17/14

[52] U.S. Cl. ..... 256/65; 256/21; 403/347

[58] Field of Search ..... 403/347, 346; 256/21, 256/22, 65, DIG. 69

[56] References Cited

U.S. PATENT DOCUMENTS

| | | | |
|---|---|---|---|
| 447,231 | 2/1891 | Cleaveland | 256/65 |
| 666,947 | 1/1901 | Ward | 256/65 |
| 2,557,002 | 6/1951 | Lathrop | 256/65 |
| 4,142,711 | 3/1979 | Brimhall | 403/346 X |
| 4,477,059 | 10/1984 | Willis | 256/65 |

*Primary Examiner*—Andrew V. Kundrat

*Attorney, Agent, or Firm*—Harry M. Weiss

[57] ABSTRACT

This is an improved fence system comprising a plurality of vertical support type fence posts with each post preferably having a pair of "saddle support" members to support a pair of preferably parallel tube members that are preferably fabricated of Electrical Metallic Tubing (EMT) commonly used in electrical installations, or of any other type of suitable material such as light weight galvanized tubing. The EMT can be coated with an enamel type paint, or any other type of suitable paint. The "saddle support" members serve as both a connecting link and support for the fence horizontal tube members or sections. The horizontal fence sections are easily attached by means of two metal screws that secure these sections to the post's "saddle support." The bottom portion of each fence post can be secured, for example, into a pool's cool deck for easy installation and removal, or it can be permanently attached to any suitable surface.

8 Claims, 2 Drawing Sheets

FENCE POST WITH SADDLE SUPPORT CONSTRUCTION AND METHOD THEREFORE

BACKGROUND OF THE INVENTION

1. Field of the Invention

This invention relates generally to an improved type of fence post and method therefore and, more specifically, to an improved fence post and method therefore which includes at least two saddle support members for supporting and connecting parallel tubular members.

2. Description of the Prior Art

In the past, fences have been constructed out of iron, wood or chain link, among several other types of materials. For example, chain link fences have been constructed using periodic vertical fence posts that served as connecting members and supports in between sections of chain link fence material. Prior art fence systems were generally fairly complicated, expensive and required long periods of time to construct.

A need existed to provide an improved fence system and method which would permit the use of inexpensive preferably metal tubular members to be used in both horizontal and vertical configurations. Thus, fence posts were needed to both support and connect these horizontal tubular members in a manner that provided a more reliable structural support while still permitting greater ease in installation.

It is an object of the instant invention to provide an improved fence system and method therefore.

It is another object of this invention to provide an improved fence post and method therefore.

It is a further object of this invention to provide an improved fence post and method therefore which includes improved "saddle support" members for permitting increased structural support for as well as ease in connection to parallel horizontal fence members.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENT

Figure 1:
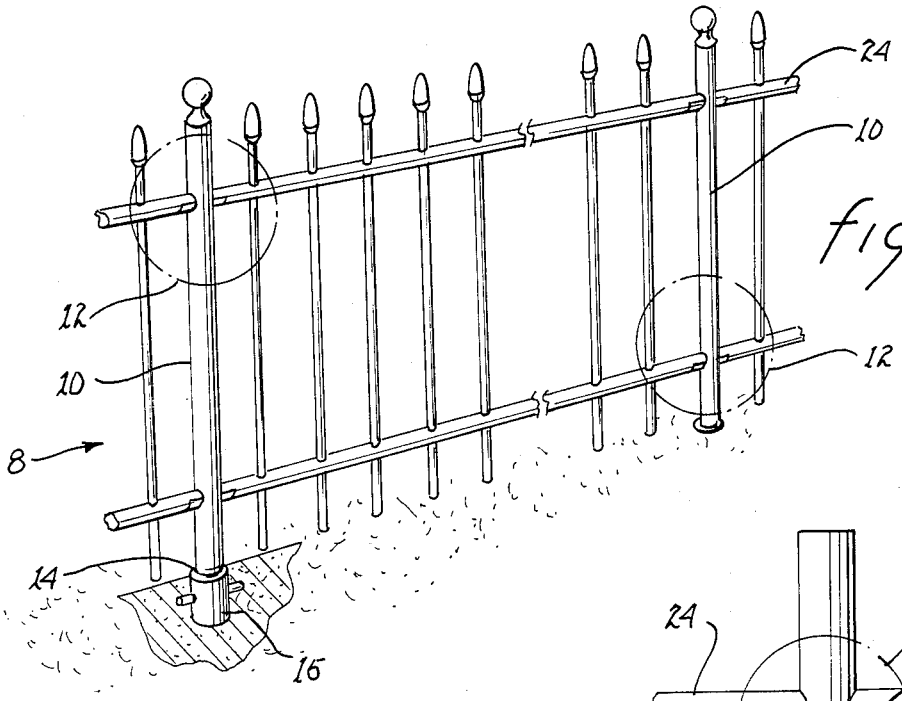
FIG. 1 is a side elevational view of a fence system in accordance with this invention depicting vertical support posts showing the profile of each post and the pair of "saddle support" plate members attached thereto.

Referring to FIG. 1, a fence system is generally designated by reference number 8 which depicts vertical and horizontal tubular members which includes vertical support posts 10. The fence support posts 10 in this embodiment are each shown as having two support and attachment section holes 11 (see FIG. 4) which are contained within encircled portions designated by reference number 12. The support posts 10 each comprise a threaded ground end designated by reference number 14, for easy attachment to a sleeve 15 that is, for example, cemented or anchored into a surface such as a pool deck or any other suitable surface (see FIG. 7).

Figure 2:
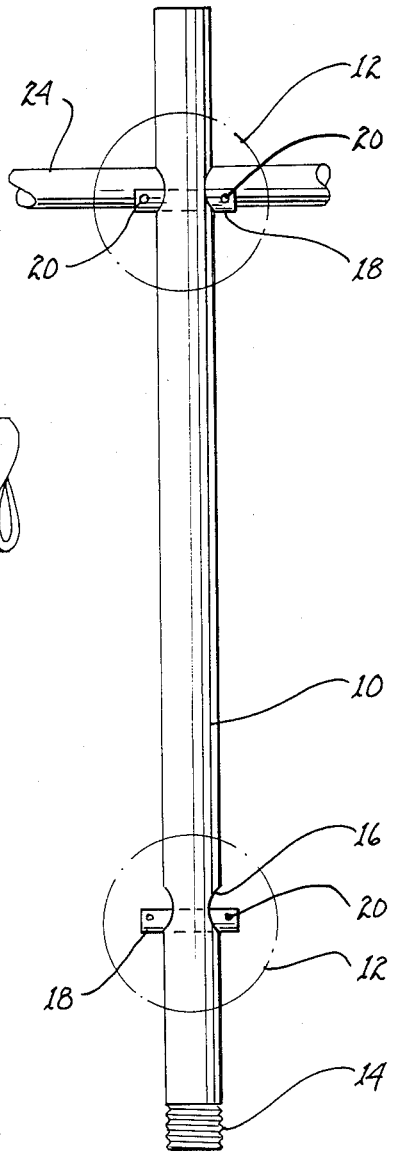
FIG. 2 is an enlarged drawing of one vertical support post showing the location of each "saddle support" member or plate connected to a horizontal tubular member at the top portion and unconnected at the bottom portion.

Referring to FIG. 2, a rim portion of the post hole 11 (see FIG. 4) is designated by reference number 16, a "saddle support" plate is designated by reference number 18, and the metal screw hole of the "saddle support" plate 18 for the fence horizontal section attachment is designated by reference number 20.

Figure 3:
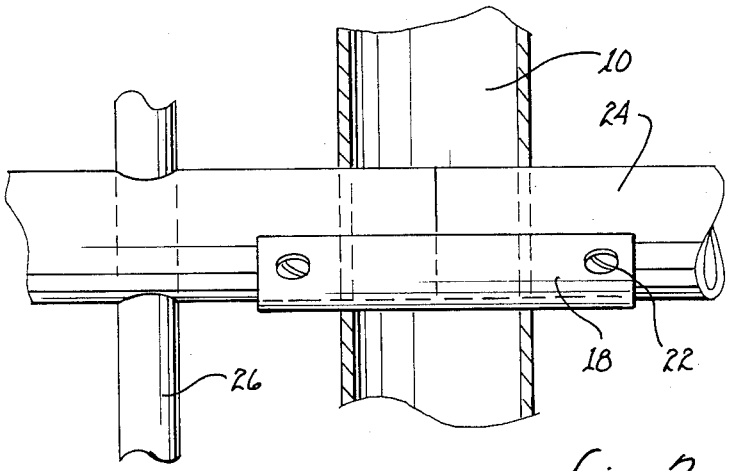
FIG. 3 is an enlarged view partly in section of the connected or assembled "saddle support" plate as shown in FIG. 2.
Figure 5:
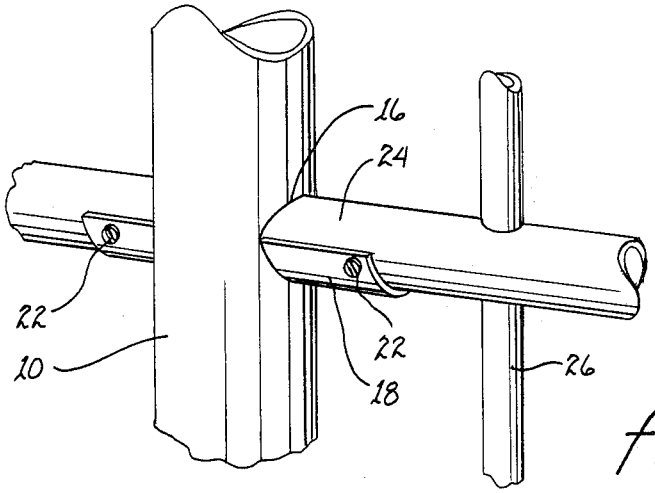
FIG. 5 is a partial perspective view which shows the mounting of one fence horizontal tubular member or section to a "saddle support" plate positioned within one hole in a support post.

Referring to FIGS. 1, 2, 3, 5 and 6, horizontal tubular members which are designated by reference number 24 are attached to each "saddle support" plate 18 by means of metal screws designated by number 22 (see FIGS. 3 and 5). As shown in FIG. 3, each of the "saddle support" plates 18 are depicted as being partially arcuate shaped and extending through the opening 11 attached to the bottom portion of the rim 16 of the support post 10. The arcuate concave shape of the "support plates" 18 in combination with the fact that the "support plates" 18 extend through the hole 11 and are in contact with the bottom portion of the rim 16 of the support post 10 provides a significant amount of structural strength to the fence system. Thus, the horizontal tubular members 24 are significantly better supported by means of the "saddle support" plates 18.

Figure 4:
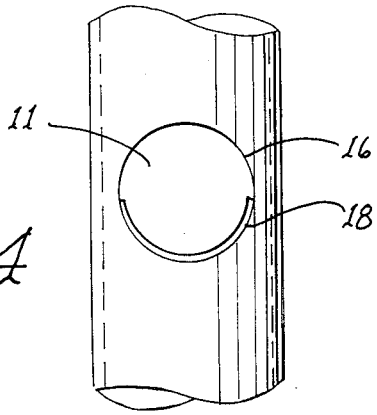
FIG. 4 is a side elevational view from one side showing a support post hole and the "saddle support" plate located at the bottom portion thereof.

Referring to FIG. 4, a front view is shown of the rim 16 with the "saddle supports" 18 firmly attached to the rim 16 of post 10 by means of brazing, welding or the like.

Referring to FIG. 5, there is shown a fence support post 10 fully connected to a fence horizontal tubular section designated by reference number 24 firmly secured to the "saddle support" plate 18 by means of a pair of metal screws each designated by reference number 22. Also shown is one of the vertical fence pickets designated by reference number 26.

Figure 6:
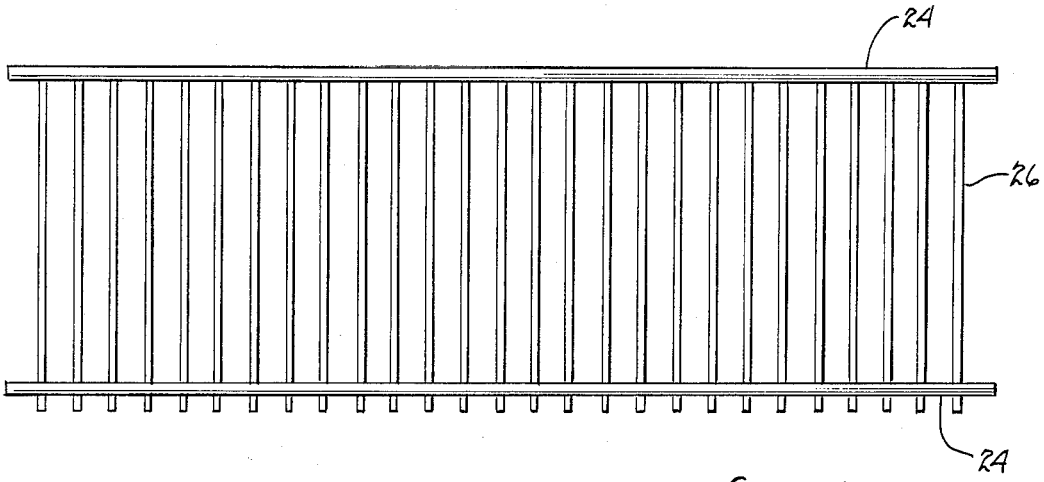
FIG. 6 is a side elevational view which shows a somewhat different fence section configuration than depicted in FIG. 1 that can be attached to the support fence posts of this invention.

Referring to FIG. 6, a different configuration of fence sectional system is shown which is attached by means of the horizontal tubular member 24 to support posts 10 (not shown). For example, a 43" height section of fence can be used with, for example, ten foot long horizontal tubular members 24, and a plurality the number, of course, depends upon the spacing of vertical pickets 26.

Figure 7:
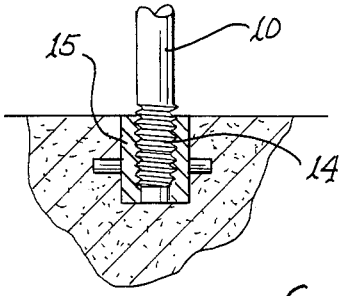
FIG. 7 is a view of the bottom of a fence support post which shows support post's attachment to a pool deck or any other suitable surface.

Referring to FIG. 7, there is shown a support post 10 attached to a pool deck or any other suitable surface by means of its threaded lower end 14 threadedly connected to the inner threaded portion of the sleeve 15.

While the invention has been particularly shown and described with reference to preferred embodiments thereof, it will be understood by those skilled in the art that the foregoing and other changes in form and details may be made therein without departing from the spirit and scope of the invention.

I claim:

1. A fence system comprising, in combination, at least one support post having at least one opening therethrough;

a concave arcuate shaped support member located in said opening of said support post;

at least one horizontal member connected to said concave arcuate shaped support member of said support post, said concave arcuate shaped support member extending through the opening in said support post;

said concave arcuate shaped support member being made of metal and connected to a metal rim defining said opening; and screw means for attaching said horizontal member to said concave arcuate shaped support member of said support post.

2. A fence system in accordance with claim 1 including a plurality of support posts, each of said plurality of support posts having at least two openings therethrough, each of said openings having a concave arcuate shaped support member located in said opening of said support post, and a pair of horizontal members, each one of said pair connected to said concave arcuate shaped support member in each of said openings.

3. A fence system in accordance with claim 2 wherein each of said pair of horizontal members being a metal tube.

4. A fence system in accordance with claim 3 wherein each of said pair of metal horizontal members being a EMT member.

5. A method for assembling a fence system comprising providing at least one support post having at least one opening therethrough;

connecting a concave arcuate shaped support member to said opening of said support post;

attaching at least one horizontal member to said concave arcuate shaped support member of said support post, said concave arcuate shaped support member extending through the opening in said support post;

said concave arcuate shaped support member being made of metal and connected to a metal rim defining said opening; and attaching said horizontal member to said concave arcuate shaped support member of said support post by means of screws.

6. The method of claim 5 including providing a plurality of support posts, each of said plurality of support posts having at least two openings therethrough, providing a concave arcuate shaped support member in each of said openings of said support post, and connecting each one of a pair of horizontal members to said concave arcuate shaped support members in each of said openings.

7. The method of claim 6 wherein each of said pair of horizontal members being a metal tube.

8. The method of claim 7 wherein each of said pair of metal horizontal members being a EMT member.

* * * * *